US009149407B2

(12) United States Patent
Hesse et al.

(10) Patent No.: US 9,149,407 B2
(45) Date of Patent: Oct. 6, 2015

(54) DEVICE FOR THERAPEUTICALLY TREATING AND/OR TRAINING THE LOWER EXTREMITIES OF A PERSON

(75) Inventors: Stefan Hesse, Berlin (DE); Rupert Waldner, Bozen (IT); Christopher Tomelleri, Bozen (IT); Julius Michael Waldner, Bozen (IT)

(73) Assignee: REHA TECHNOLOGIES GMBH, Bozen (IT)

( * ) Notice: Subject to any disclaimer, the term of this patent is extended or adjusted under 35 U.S.C. 154(b) by 668 days.

(21) Appl. No.: 13/322,309

(22) PCT Filed: May 21, 2010

(86) PCT No.: PCT/EP2010/003131

§ 371 (c)(1),
(2), (4) Date: Dec. 12, 2011

(87) PCT Pub. No.: WO2010/136160

PCT Pub. Date: Dec. 2, 2010

(65) Prior Publication Data

US 2012/0101414 A1 Apr. 26, 2012

(30) Foreign Application Priority Data

May 25, 2009 (DE) ..... 10 2009 022 560

(51) Int. Cl.
*A61H 1/00* (2006.01)
*A61H 1/02* (2006.01)
(Continued)

(52) U.S. Cl.
CPC ..... *A61H 1/0255* (2013.01); *A61H 1/005* (2013.01); *A61H 1/0262* (2013.01);
(Continued)

(58) Field of Classification Search
CPC ..... A61H 1/0262; A61H 3/008
USPC ..... 601/5, 23, 24, 26, 27, 29, 31–35, 84, 601/97, 98, 101, 103, 104; 482/51, 52, 54, 482/69, 70, 71
See application file for complete search history.

(56) References Cited

U.S. PATENT DOCUMENTS 3,824,994 A * 7/1974 Soderberg, Sr. ..... 601/29
5,573,480 A * 11/1996 Rodgers, Jr. ..... 482/57
(Continued)

FOREIGN PATENT DOCUMENTS

DE 8109699 U1 10/1981
DE 8528083 U1 1/1986
(Continued)

OTHER PUBLICATIONS

"Boom." Miriam-Webster Online Dictionary. http://www.merriam-webster.com/dictionary/boom?show=0&t=1421958880. Accessed Jan. 22, 2015.*
(Continued)

*Primary Examiner* — Justine Yu
*Assistant Examiner* — Kathrynn Reilly
(74) *Attorney, Agent, or Firm* — Brooks Kushman P.C.

(57) ABSTRACT

A device for therapeutically treating and/or training the lower extremities of a person, having driven controllable motion devices connected to a stationary frame and retaining means for attaching to each extremity, that can be displaced independently along walking trajectories. Motion devices provide an outrigger pivotable to various height levels, jointedly connected at a first carriage of a linear guide on one side, and rotationally connected to a retaining means on the other side. A second carriage of the linear guide is disposed ahead of the first carriage and jointedly connected to the outrigger by means of a connecting element. The first carriage has a first linear drive for changing the longitudinal position of each retaining means, the second carriage providing a second linear drive for changing the height level of each retaining means. The outrigger provides a rotary drive for changing the slope of each retaining means.

11 Claims, 4 Drawing Sheets

(51) Int. Cl.

| | |
|---|---|
| ***A63B 21/00*** | (2006.01) |
| ***A63B 21/005*** | (2006.01) |
| ***A63B 22/06*** | (2006.01) |
| ***A63B 69/00*** | (2006.01) |
| *A63B 21/008* | (2006.01) |
| *A63B 22/00* | (2006.01) |

(52) U.S. Cl.

CPC ..... *A63B 21/0058* (2013.01); *A63B 21/00178* (2013.01); *A63B 21/00181* (2013.01); *A63B 22/0056* (2013.01); *A63B 22/06* (2013.01); *A63B 69/0064* (2013.01); *A63B 21/0083* (2013.01); *A63B 21/0087* (2013.01); *A63B 22/0046* (2013.01); *A63B 2022/0038* (2013.01)

(56) References Cited

U.S. PATENT DOCUMENTS

| | | | | |
|---|---|---|---|---|
| 5,626,540 | A * | 5/1997 | Hall | 482/69 |
| 6,027,430 | A | 2/2000 | Stearns et al. | |
| 6,926,646 | B1 | 8/2005 | Nguyen | |
| 2007/0004567 | A1 * | 1/2007 | Shetty et al. | 482/69 |
| 2010/0268129 | A1 * | 10/2010 | Park | 601/35 |

FOREIGN PATENT DOCUMENTS

| | | | |
|---|---|---|---|
| DE | 3618686 | A1 | 12/1987 |
| DE | 19529764 | A1 | 2/1997 |
| DE | 10028511 | A1 | 5/2002 |
| DE | 102006035715 | A1 | 2/2008 |
| DE | 202008001590 | U1 | 7/2008 |
| WO | 03004107 | A1 | 1/2003 |
| WO | 03018140 | A1 | 3/2003 |
| WO | 2007122627 | A2 | 11/2007 |

OTHER PUBLICATIONS

"Derrick." Miriam-Webster Online Dictionary. http://www.merriam-webster.com/dictionary/derrick. Accessed Jan. 22, 2015.*

Search Report for Austrian Application No. GM 825/2009, dated Dec. 20, 2011, 3 Pages.

International Search Report for PCT/EP2010/003131, English translation attached to original, Both Completed by the European Patent Office on Aug. 17, 2010, All together 5 Pages.

* cited by examiner

DEVICE FOR THERAPEUTICALLY TREATING AND/OR TRAINING THE LOWER EXTREMITIES OF A PERSON

CROSS-REFERENCE TO RELATED APPLICATION

This application is the U.S. national phase of PCT Appln. No. PCT/EP2010/003131 filed May 21, 2010 which claims priority to German application DE 10 2009 022 560.9 filed May 25, 2009, the disclosures of which are incorporated in their entirety by reference herein.

The invention relates to an apparatus for therapeutically treating or training the lower extremities of a person.

An apparatus of this kind is known from DE 10 2006 035 715 A1, for example.

Therapy of severe weakness of the lower extremities, for example following a stroke, is difficult and often unsuccessful. Conventional physiotherapy is complicated and in most cases is aimed at triggering spastically induced muscle cramps and performing walking exercises when sitting and standing, for example to strengthen the weight transfer to the affected leg. This procedure often means that the patient does not repeatedly practice walking and, consequently, the foot and leg movements on which walking is based.

Modern scientific concepts of rehabilitation favor repeated and, if possible, active practice in walking as early as possible, or, if this is not yet possible, the practice of at least individual movement sequences of walking with the feet and legs. For stroke patients, it has been possible to show that repeated active, isometric and isotonic dorsal extension of the feet and legs was superior to conventional therapy as regards the recovery of the motor function of the whole of the lower extremities. Still greater success was able to be achieved if the patient practiced walking repeatedly. Passive movements of paralyzed areas of the extremities preserve, on the one hand, the mobility of the movement segment and, on the other hand, the brain's recall of the sequence of movement.

Bilateral exercising of the healthy side and of the weakened side of the lower extremities is superior to unilateral exercising of the weakened side. The associated movement of the unweakened side has a positive influence on the activation of the brain structures in the parietal lobe that are responsible for the use of the paralyzed extremity.

For therapy of the healthy side and of the weakened side of the lower extremities, the prior art discloses mechanical and electro-mechanical appliances. In this connection, reference is made to DE 36 18 686 A1, DE 85 28 083 U1, DE 81 09 699 U1 and DE 195 29 764 A1, for example. These known therapy appliances comprise pedals actuated by the patient. These pedals permit only an asynchronous movement of the weakened side. Asynchronous movements do not reflect the variety of the real movement sequences. In this case, the desired transfer of the learning effect in connection with movement sequences from the brain lobe of the healthy side to the affected side is possible only to a limited extent. Variations of the movement sequences are ruled out because of the rigid mechanical connection of the construction elements.

Moreover, robotic systems for therapeutic purposes are known which comprise control systems that measure the strength of the patient during exercising. In these, different evaluations of the parameters for determining minimum spontaneous movements or forces and complete comparisons with preset programs are possible. Such robotic systems are known from DE 100 28 511 A1 and from the aforementioned DE 10 2006 035 715 A1.

In the robotic system according to DE 100 28 511 A1, the degree of freedom for lateral pivoting of the foot plates is not in itself necessary and, in addition, has proven disadvantageous during exercising. The lateral pivoting of the foot plates necessitates a complicated and protruding structure, which makes access to the patient difficult for the therapist. The robot-controlled run simulator known from DE 10 2006 035 715 A1 has proven capable of improvement in terms of everyday suitability. Moreover, as is also the case in the system according to DE 100 28 511 A1, access to the patient is difficult.

The object of the invention is to create an apparatus for therapeutically treating and/or training the lower extremities of a person, with which apparatus it is possible to simulate a wide variety of load situations that occur on an everyday basis. The apparatus is intended to allow the therapist easy access to the patient.

According to the invention, this object is achieved by the apparatus as per claim 1.

The invention is based on the concept of creating an apparatus for therapeutically treating and/or training the lower extremities of a person, with driven controllable motion devices, which are connected to a stationary frame, and retaining means, which secure one extremity each. The retaining means are movable independently of each other along walking trajectories.

The motion devices each have a jib, which is pivotable to various heights and which, at one end, is articulated on a first carriage of a linear guide and, at the other end, is rotatably connected to one of the retaining means. A second carriage of the linear guide is arranged ahead of the first carriage in the walking direction and is movable relative to the first carriage. The second carriage of the linear guide is connected to the jib in an articulated manner by a connecting element. The first carriage has a first linear drive for changing the longitudinal position of the respective retaining means, the second carriage has a second linear drive for changing the height of the respective retaining means, and the jib has a rotary drive for changing the inclination of the respective retaining means.

The invention has the advantage that the mechanics of the motion devices have a simple and compact structure. Access to the patient is in this way made easier for the therapist. With the apparatus according to the invention, successful therapy can be achieved on the one hand by frequent repetition of training elements and on the other hand by the transmission of learning effects from the side of the brain responsible for the healthy extremity to the side or area of the brain responsible for the weakened extremity. In addition, the apparatus according to the invention permits strengthening of the leg and back muscles in order to further improve the state of a patient who has made progress and in order to train healthy persons. The apparatus according to the invention provides the condition for permitting the training or walking therapy in an everyday environment shown on a screen, the robust and simple mechanics permitting simulation of different everyday situations, for example climbing stairs, mounting a pavement, or situations in which the patient stumbles.

Preferred embodiments of the invention are set forth in the dependent claims.

In one embodiment, the second linear drive comprises a force-transmitting element that couples the two carriages. The distance between the two carriages can be changed by actuation of the force-transmitting element. The coupling of the two carriages by a force-transmitting element has the advantage that one of the two carriages, in particular the second carriage, is carried along by the other carriage, in particular the first carriage. The forward movement or the horizontal movement of the motion device and therefore of the retaining element are achieved together by the first linear drive.

The second linear drive effects the relative movement between the two carriages. The force-transmitting element in this case has a dual function, on the one hand of carrying the second carriage along by the movement of the first carriage, and thus serves as a mechanical connection between the two carriages. On the other hand, the force-transmitting element provides the force needed for the relative movement of the two carriages. For this purpose, the force-transmitting element has its own drive. This embodiment has the advantage that the drives and associated carriages can be made comparatively small, such that it is possible to achieve rapid changes of movement or rapid accelerations and decelerations.

The second linear drive can comprise a rotary spindle, which is rotatably secured at one end on the first carriage and at the other end on the second carriage. The spindle drive of the rotary spindle can be secured on the second or the first carriage. This simplifies the structure of the apparatus.

The first linear drive can comprise a force-transmitting element, which couples the first carriage to the stationary frame. The first linear drive can comprise a driven chain, which is secured at one end on the first carriage and at the other end on the frame, as a result of which the horizontal movement of the first carriage and therefore also of the second carriage is achieved in a simple way.

The rotary drive for changing the inclination can be arranged at a distance from the retaining means and can be coupled to the latter by a force-transmitting means. In this way, the rotary drive can be arranged at a favorable position for the center of gravity. The rotary drive can expediently comprise a belt, which is arranged on a driving disk on the jib and on a driven disk on the retaining element.

The above-described arrangements of the respective drives permit, in each case individually and in combination with each other, a simple structure of the respective motion device, which takes up a small amount of space.

A longitudinal end of the jib is preferably articulated on the first carriage. The connecting element can engage on the jib between the articulation point on the first carriage and the retaining element. This permits in each case a favorable torque transmission from the respective drives to the jib and thus to the retaining means.

In a preferred embodiment of the invention, an adjustment device is arranged above the motion device and is designed to change the center of gravity of the body of a person connected to the retaining means. This embodiment has the advantage that the adjustment device permits control of the center of gravity of the body of a patient. In this way, it is possible, on the one hand, to simulate the center-of-gravity shift that occurs during human locomotion, i.e. during forward movement, and that takes place along the direction of movement in the vertical and lateral directions. On the other hand, by means of controlling the center of gravity, the correct execution of the therapeutic movement is permitted, and it is thus possible to avoid postural damage caused by compensatory movements of the patients. A further advantage of controlling the center of gravity of the body is that the equilibrium can be maintained in critical situations, such as (simulated) stumbling, slipping, or under conditions in which the proprioceptive component is disturbed. Repeated practice of these situations is necessary in order to minimize the risk of the patients falling. The three-dimensional control of the center of gravity, permitted in this embodiment, and the option of influencing the proprioceptive component of the patients by perturbations, create the conditions for safe, repeatable and targeted training. The perturbations of the proprioceptive component are provided by the retaining means, in particular the foot plates, which are connected to the feet of the patients. These can be moved to any desired position along the three degrees of freedom. In addition, vibrations can be provided by the retaining means.

The invention is explained in more detail below on the basis of illustrative embodiments and with reference to the attached schematic drawings, in which:

FIG. 5 shows a perspective view of a retaining means of the apparatus according to FIG. 1.

Figure 1:
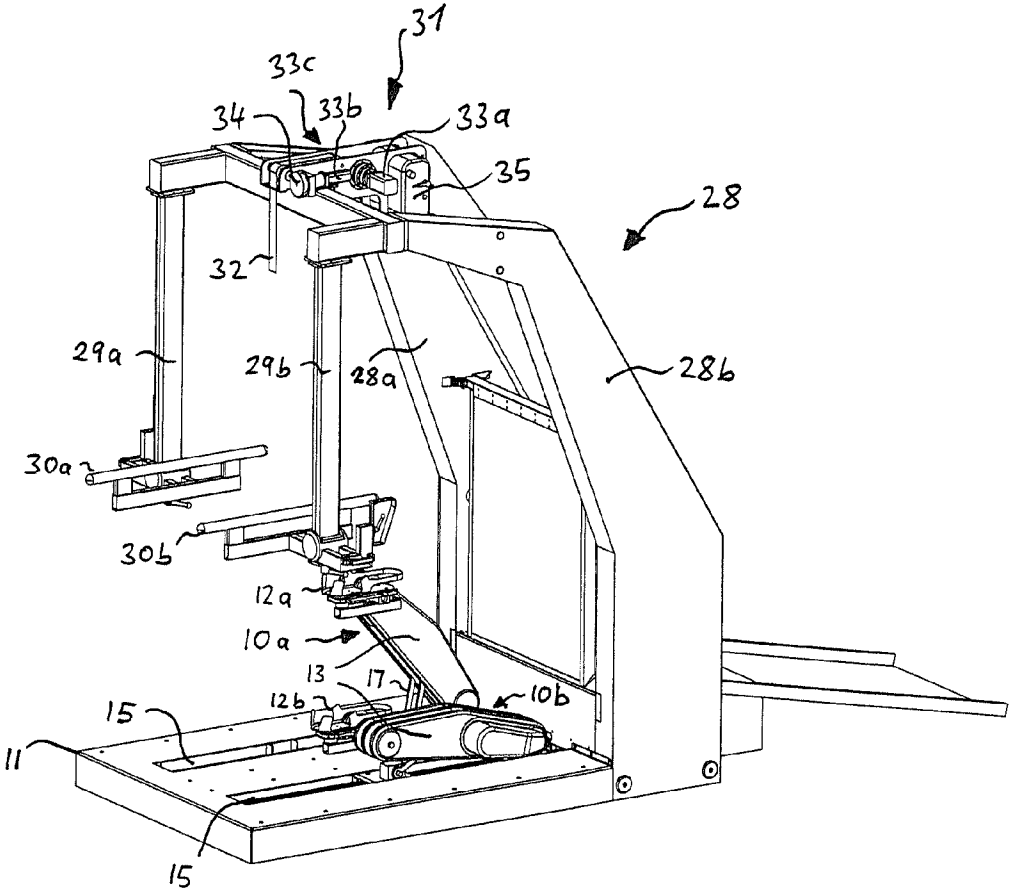
FIG. 1 shows a perspective view of an apparatus in one illustrative embodiment according to the invention.
Figure 2:
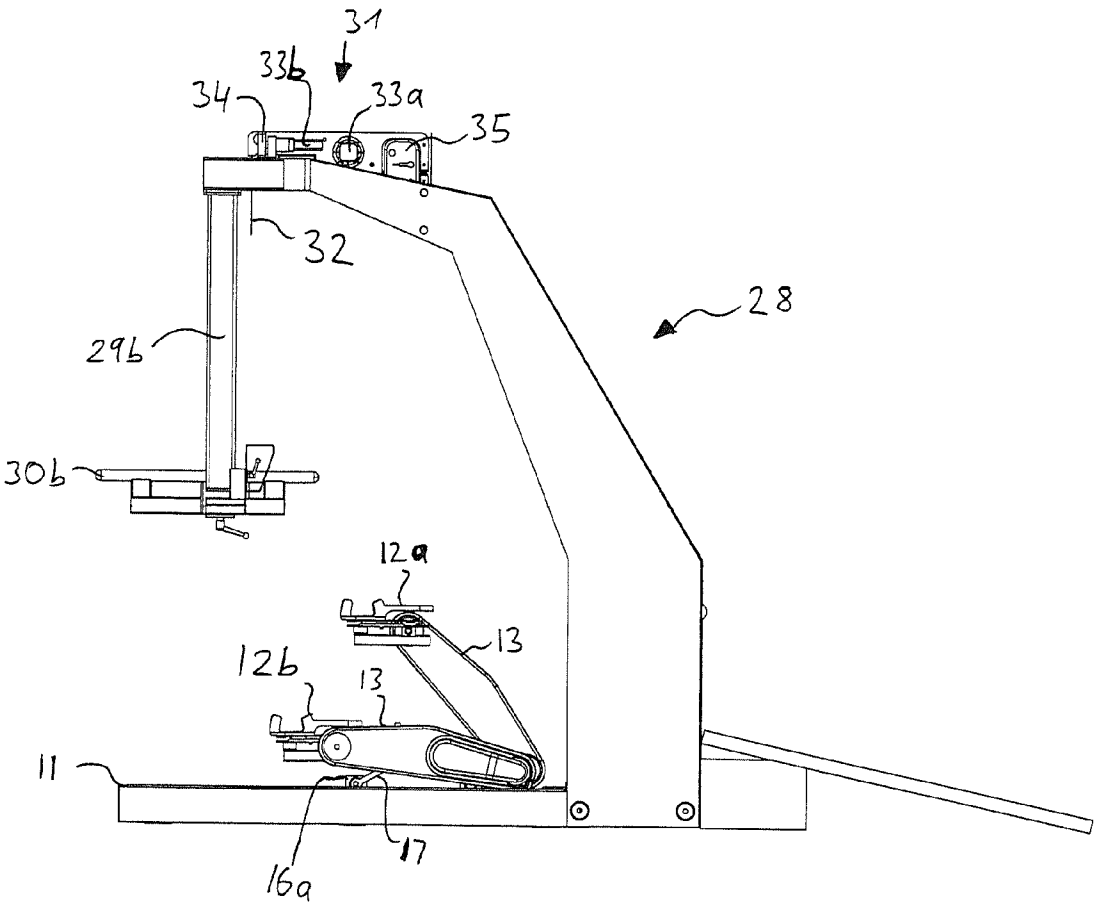
FIG. 2 shows a side view of the apparatus according to FIG. 1.

In FIG. 1 an apparatus is shown that can be used for therapeutically treating and/or training the lower extremities of a person. The apparatus is particularly well suited for training the lower extremities of neurological patients and has two driven controllable motion devices 10*a*, 10*b*. The two motion devices 10*a*, 10*b* are each connected to a stationary frame 11. The motion devices 10*a*, 10*b* have retaining means 12*a*, 12*b*, for example foot plates with bindings in which the feet of the patients or of the persons training are held. The motion devices 10*a*, 10*b* and therefore the retaining means 12*a*, 12*b* can be moved independently of each other along walking trajectories. Asynchronous or synchronous movements are possible.

The apparatus comprises a stand 28 from which the patient is suspended for weight relief and which is fixedly connected to the frame 11. The stand 28 comprises two arms 28*a*, 28*b*, which extend forward in the sagittal direction, wherein the arms 28*a*, 28*b* reach approximately as far as the height of the motion devices 10*a*, 10*b* and engage over these. At the front end of the arms 28*a*, 28*b*, vertically arranged connecting elements 29*a*, 29*b* are provided which connect the arms 28*a*, 28*b* to side spars 30*a*, 30*b*. The side spars 30*a*, 30*b* are arranged approximately at the height of the forearms of the respective patient and are vertically adjustable. The side spars 30*a*, 30*b* serve as grips for patients, who are able to hold onto the side spars 30*a*, 30*b* for support.

Figure 3:
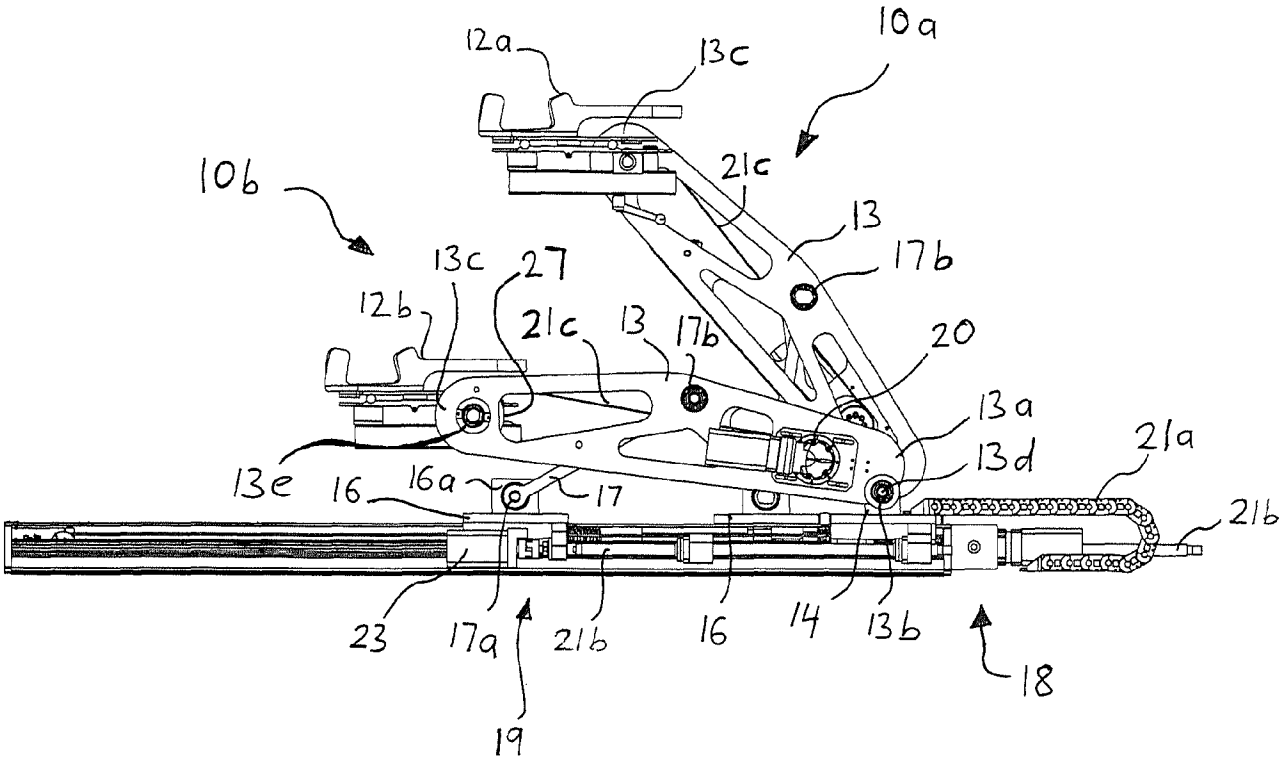
FIG. 3 shows a side view of the motion devices of the apparatus according to FIG. 1.

The motion devices 10*a*, 10*b* each have a jib 13, which is pivotable to different heights. For this purpose, the jib 13 is articulated pivotably on a first carriage 14, which is guided in a linear guide 15. The linear guide 15 is fixedly connected to the stationary frame 11 and forms a rail in which the carriage 14 is movably arranged. As can be seen in FIG. 3, the jib 13 is articulated at a first longitudinal end 13*a* on the first carriage 14. For this purpose, a first rotary bearing 13*b* is provided, which connects the jib 13 to the first carriage 14 in a pivotable manner. The first rotary bearing 13*b* can be arranged at another place on the jib 13, for example at a distance from the longitudinal end 13*a*.

The jib 13 is in each case connected rotatably to one of the retaining means 12*a*, 12*b*. The connection point between the retaining means 12*a*, 12*b* and the jib 13 is located at the other, second longitudinal end 13*c* of the jib 13 and has a second rotary bearing 13*e* at a distance from the first rotary bearing 13*b*.

The jib 13 forms a pivot arm extending in the longitudinal direction of the respective linear guide 15.

A second carriage 16, which is guided movably in the linear guide 15, is arranged ahead of the first carriage 14 in the walking direction, i.e. in the direction of the forward movement of the patient during use. The second carriage 16 is movable relative to the first carriage 14, such that the distance between the two carriages 14, 16 can be changed. As can be seen in FIG. 3, the second carriage 16 is connected to the jib 13 in an articulated manner by a connecting element 17. The connecting element 17 can, for example, comprise one linking rod or two linking rods arranged in parallel alongside each other. Other connecting elements 17 are possible. The connecting element 17 engages at one end on a bearing block 16*a* of the second carriage 16 and at the other end on the jib 13 between the articulation point 27 on the first carriage 14 and the retaining element 12*a*, 12*b*. The connecting element is connected to the second carriage 16 and to the jib 13 by two rotary bearings 17*a*, 17*b*. The rotary bearing 17*b* in the jib 13 is arranged approximately centrally between the articulation point 13*d* on the first carriage 14 and the retaining element 12*a*, 12*b*. Another arrangement of the rotary bearing 17*b* on the jib 13 is possible, in particular an eccentric arrangement.

Generally, the connecting element 17 is articulated on the jib 13 in an area or at a location that is arranged between the connection of the jib 13 to the first carriage 14 and the connection of the jib 13 to the retaining means 12*a*, 12*b*.

The connecting element 17 and the jib 13 form, together with the first and second carriages 14, 16, a kind of scissor mechanism. The angle between the jib 13 and the connecting element 17 is changed by the relative movement of the two carriages 14, 16 to each other. As is shown in FIG. 3 with reference to the two jibs 13, a reduction of the angle, i.e. a reduction of the distance between the two carriages 14, 16, has the effect that the jib 13 is moved upward, the retaining means 12*a*, 12*b* describing a circular trajectory about the articulation point 13*d* of the jib 13 on the first carriage 14 or generally about a horizontal axis extending transversely with respect to the walking direction. This changes the height of the second longitudinal end 13*c* of the jib 13 and, consequently, of the retaining means 12*a*, 12*b* connected to the second longitudinal end 13*c*.

On account of the jib 13 being articulated on the first carriage 14, the jib 13 is carried along, together with the first carriage 16, by a movement of the first carriage 14, as a result of which the horizontal movement of the whole motion device 10*a*, 10*b* is achieved.

The first carriage 14 can also be designated as main carriage, and the second carriage 16 as relative carriage.

Figure 4:
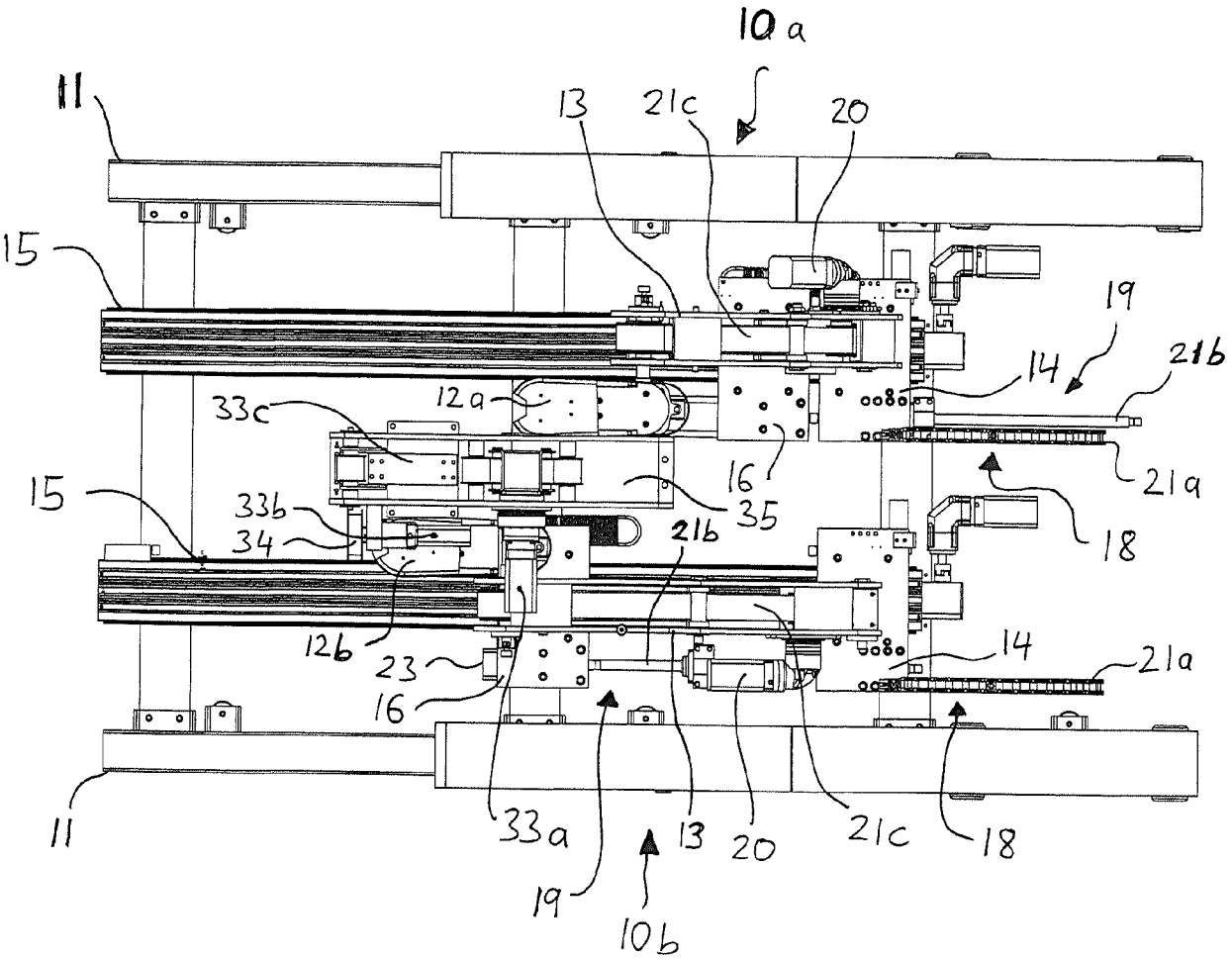
FIG. 4 shows a plan view of the apparatus according to FIG. 1.

As can be seen in FIGS. 3 and 4, the first carriage 14 has a first linear drive 18, which is provided for changing the longitudinal position or horizontal position of the respective retaining means 12*a*, 12*b*. The first linear drive 18 comprises a first force-transmitting means 21*a*, which connects the first carriage 14 to the stationary frame 11 for force transmission.

The first force-transmitting means 21*a* can comprise a driven chain, which is connected at one end to the movable carriage 16 and at the other end to the stationary frame 11. An electric motor is provided for driving the chain 24. The first linear drive 18 can also be embodied by different means, for example by a toothed rack or by hydraulic or pneumatic cylinders.

The second linear drive 19 is assigned to the second carriage 16 and couples the latter to the first carriage 14. For this purpose, a second force-transmitting element 21*b* is provided, which engages at one end on the first carriage 14 and at the other end on the second carriage 16. The second force-transmitting element has the function of ensuring that the second carriage 16 is carried along in a movement of the first carriage 14. The second force-transmitting element 21*b* acts as a pushing and pulling element. In addition, by means of the second force-transmitting element 21*b*, a force can be transmitted from the second carriage 16 to the first carriage 14 or vice versa, when the second force-transmitting element 21*b* is actuated. The distance between the two carriages 14, 16, and therefore the height of the jib 13, is changed in this way.

The second linear drive 19 acts generally as a relative drive between the two carriages 14, 16, wherein one of the two carriages 14, 16, in particular the first carriage 14, forms an abutment, and the other carriage 14, 16, in particular the second carriage 16, is movable relative to the abutment, specifically by actuation of the second linear drive 19. The first linear drive 18 forms a main drive, which moves both carriages 14, 16 together with the second linear drive relative to the stationary frame 11. The second linear drive 19, in particular the force-transmitting element 21*b*, acts as a carrier that transmits the drive force of the first linear drive 18 to the second carriage. In addition, the second linear drive 18 acts as a relative drive for the relative movement between the two carriages 14, 16, as has been described above.

The second force-transmitting element 21*b* can, for example, comprise a rotary spindle 22, which is 20 connected rotatably to the first and second carriages 14, 16 and ensures the forward movement of the second carriage 16. In the illustrative embodiment according to FIG. 4, the spindle drive 23 is secured on the second carriage 16 and is coupled to the rotary spindle 22. It is also possible for the spindle drive 23 to be secured on the first carriage 14. Accordingly, the spindle nut of the spindle drive can be arranged optionally on the first or on the second carriage 14, 16. Other force-transmitting elements are possible, for example a toothed rack or hydraulic/pneumatic actuating elements. The force-transmitting element 21*b* generally has a dual function and serves both as a carrier and also for changing the distance between the two carriages 14, 16.

By actuation of the second linear drive 19, the distance between the two carriages 14, 16 is changed, as is shown in FIG. 4.

In the motion device 10*a* arranged to the right in the forward direction, the two carriages 14, 16 are located close to each other, with the rotary spindle protruding rearward beyond the frame 11. In this position, the jib 13 is arranged at the maximum height. With the rotary spindle 22 driven out to the maximum extent as shown in the left-hand motion device 10*b*, the jib 13 is located at the lowest height.

To adjust the inclination of the retaining means 12*a*, 12*b*, a rotary drive 20 is provided, which cooperates with the respective rotatably movable retaining means 12*a*, 12*b*. The rotary drive 20 is arranged in the area of the articulation point 13*d*.

The connection of the 15 rotary drive 20 to the respective retaining means 12*a*, 12*b* is provided by a third force-transmitting element 21*c*, for example in the form of a belt 25. The belt 25 is arranged, at one end, on a driving disk 26 on the jib 13 and, at the other end, on a driven disk 27, which is connected to the retaining element 12*a*, 12*b*. Instead of the belt 25, other force-transmitting elements 21*c* can be used that convert a translation movement into a rotation movement, for example a toothed rack that meshes with a pinion on the retaining means 12*a*, 12*b*. The inclination of the retaining means 12*a*, 12*b* is adjusted by the rotary drive 20 and adapted to the respective position of the jib 13. It is possible to variably set all the possible inclination positions that are needed for simulation of everyday situations.

The movement of the retaining means 12*a*, 12*b* takes place in a work plane extending in the sagittal direction, wherein a work space that has proven expedient permits the forward movement in the range of 400 to 600 mm, particularly 550 mm, the height movement in the range of 300 to 500 mm, particularly 400 mm, and the pivoting movement of the retaining means 12*a*, 12*b* in a range from −80° to +30°.

The pivoting movement of the retaining means 12*a*, 12*b* takes place about a horizontally extending axis. The horizontally extending axis is shifted in the horizontal and vertical direction by the actuation of the two linear drives 18, 19.

To simulate everyday situations of human locomotion, the retaining means 12*a*, 12*b* for the lower extremities, with the patient standing on them and secured to them, can be simulated both by programmed settings of the control and also by the patient acting on resilient foot plates. It is possible to change, as and when desired, between the programmed movement and the movement guided by the patient. Alternatively, one retaining means 12*a* can be controlled by the patient and the other retaining means 12*b* by programmed settings.

In the illustrative embodiment according to FIG. 1, an adjustment device 31 is provided, which is arranged above the motion devices 10*a*, 10*b*. The adjustment device 31 is located above the linear guides 15, such that the motion devices 10*a*, 10*b*, in particular the retaining means 12*a*, 12*b*, can be moved under the adjustment device 31. The adjustment device 31 is designed to control the center of gravity or to change the center of gravity of the body of a person connected to the retaining means 12*a*, 12*b*. The adjustment device allows the center of gravity of the body to be changed in the vertical direction and also in the transverse direction. For this purpose, the adjustment device 31 comprises a vertical drive 33*a*, which cooperates with a strap 32. The strap 32 is connected to a patient-supporting strap (not shown). The vertical drive permits a change in the length of the vertical portion of the strap 32, such that the center of gravity of the patient can be changed in the vertical direction. The work space of the mechanism or of the adjustment device 31 for changing the center of gravity measures +/−10 cm relative to a zero position. Other ranges are possible. An example of the design of the adjustment device 31 is shown in FIG. 1 and can comprise a rotary drive, which is connected to a pivot mechanism 33*c*. The pivot mechanism 33*c* shortens the supporting strap of the patient via a roller system and thus draws the center of gravity of the patient upward. A lowering of the patient or lengthening of the strap 32 is likewise possible.

The pivot mechanism 33*c* has a pivot arm on which three rollers are secured. The rollers, in particular two end rollers and a central roller arranged between the two end rollers, serve to guide the strap 32 and form an arrangement by which the center of gravity of the body of a patient can be changed. Each one of the two end rollers is located at a respective end of the pivot arm. The central roller is arranged centrally at the rotation point or pivot point of the pivot arm. The strap 32 extends from the patient lifter 35 over the first end roller, under the central roller and, from there, over the second end roller through the pivot mechanism to the patient strap. The vertical drive, in particular the rotation drive 33*a*, effects a pivoting movement about the rotation point of the pivot mechanism, in particular of the pivot arm. In this way, the end rollers at the end of the pivot arm are raised or lowered and thus raise or lower the strap 32.

Other devices for raising and lowering the strap 32 are possible.

The patient lifter 35 serves to lift the patient into the treatment position or to lower the patient from the treatment position after the treatment has ended.

To control the transverse component of the center of gravity, a transverse drive 33*b* is provided, which has a rotation drive connected to a disk 34. A rope (not shown) is secured to the disk 34, the ends of the rope extending as far as the patient. The rope is guided via a roller system (not shown) and engages at both ends, for example by carbines, on lateral eyelets of the patient strap. By rotation of the disk 34, the patient is pulled in the transverse direction by the shortening of one of the two rope ends. A possible work space for the center-of-gravity shift permitted by the transverse drive 33*b* measures, for example, +/−5 cm relative to a zero position. Other ranges are possible.

The control of the center of gravity in the forward or rearward direction is effected by the relative movement of the retaining means 12*a*, 12*b* or of the foot plates relative to the suspension point of the adjustment device 31. The position of the first carriage 14 (main carriage) can be controlled freely on the linear guide 15. The suspension point of the patient is stationary in a direction parallel to the linear guide 15, such that a corresponding shifting of the center of gravity is possible. The work space allowed by the carriage length measures +/−10 cm relative to a zero position. Other ranges are possible.

The apparatus permits extremely variable and flexible therapy or training of the lower extremities, and the apparatus has a simple and compact structure and thus ensures easy access for the patient.

The following subject matter is disclosed as belonging to the invention:

1. An apparatus for therapeutically treating and/or training the lower extremities of a person, with driven controllable motion devices (10*a*, 10*b*), which are connected to a stationary frame (11), and retaining means (12*a*, 12*b*), which secure one extremity each and are movable independently of each other along walking trajectories, wherein the motion devices (10*a*, 10*b*) each have a jib (13), which is pivotable to various heights and which, at one end, is articulated on a first carriage (14) of a linear guide (15) and, at the other end, is rotatably connected to one of the retaining means (12*a*, 12*b*),
   characterized in that a second carriage (16) of the linear guide (15) is arranged ahead of the first carriage (14) in the walking direction, is movable relative to the first carriage (14) and is connected to the jib (13) in an articulated manner by a connecting element (17), wherein the first carriage (14) has a first linear drive (18) for changing the longitudinal position of the respective retaining means (12*a*, 12*b*), the second carriage (16) has a second linear drive (19) for changing the height of the respective retaining means (12*a*, 12*b*), and the jib (13) has a rotary drive (20) for changing the inclination of the respective retaining means (12*a*, 12*b*).
2. The apparatus as per number 1,
   characterized in that the second linear drive (19) comprises a force-transmitting element (21*b*) that couples the two carriages (14, 16), and the distance between the two carriages (14, 16) can be changed by actuation of the force-transmitting element (21*b*).
3. The apparatus as per number 1 or 2,
   characterized in that the second linear drive (19) comprises a rotary spindle (22), which is rotatably secured at one end on the first carriage (14) and at the other end on the second carriage (16).
4. The apparatus as per number 3, characterized in that a spindle drive (23) of the rotary spindle (22) is secured on the second or the first carriage (14, 16).
5. The apparatus as per numbers 1 through 4,
   characterized in that the first linear drive (18) comprises a force-transmitting element (21*a*), which couples the first carriage (14) to the stationary frame (11).

6. The apparatus as per at least one of numbers 1 through 5, characterized in that the first linear drive (18) comprises a driven chain (24), which is secured at one end on the first carriage (14) and at the other end on the frame (11).
7. The apparatus as per at least one of numbers 1 through 6, characterized in that the rotary drive (20) for changing the inclination is arranged at a distance from the retaining means (12*a*, 12*b*) and is coupled to the latter by a force-transmitting means (21*c*).
8. The apparatus as per at least one of numbers 1 through 7, characterized in that the rotary drive (20) comprises a belt (25), which is arranged on a driving disk (26) on the jib (13) and on a driven disk (27) on the retaining element (12*a*, 12*b*).
9. The apparatus as per at least one of numbers 1 through 8, characterized in that a longitudinal end (13*a*) of the jib (13) is articulated on the first carriage (14).
10. The apparatus as per at least one of numbers 1 through 9, characterized in that the connecting element (17) engages on the jib (13) between the articulation point (13*d*) on the first carriage (14) and the retaining element (12*a*, 12*b*).
11. The apparatus as per at least one of numbers 1 through 10, characterized in that an adjustment device (31) is arranged above the motion device (10*a*, 10*b*) and is designed to change the center of gravity of the body of a person connected to the retaining means (12*a*, 12*b*).

List of Reference Signs

10*a*, 10*b* motion devices
11 frame
12*a*, 12*b* retaining means
13 jib
13*a* first longitudinal end
13*b* first rotary bearing
13*c* second longitudinal end
13*d* articulation point
13*e* second rotary bearing
14 first carriage
15 linear guide
16 second carriage
16*a* bearing block
17 connecting element
17*a*, 17*b* rotary bearing
18 first linear drive
19 second linear drive
20 rotary drive
21*a*, 21*b*, 21*c* force-transmitting element
22 rotary spindle
23 spindle drive
26 driving disk
27 driven disk
28 stand
28*a*, 28*b* arms
29*a*, 29*b* connecting elements
30*a*, 30*b* side spars
31 adjustment device
32 strap
33*a* vertical drive
33*b* transverse drive
33*c* pivot mechanism
34 adjustment disk

The invention claimed is:

1. An apparatus for therapeutically treating and/or training lower extremities of a person, the apparatus comprising:

a frame including a pair of side-by-side linear guides;

a pair of retainers that each secure one extremity of the person and are movable independently of each other along walking trajectories;

a pair of driven controllable motion devices each associated with one of the linear guides, wherein each of the motion devices includes first and second carriages disposed in one of the linear guides and movable along that linear guide in a horizontal direction, and including an arm connected to one of the retainers and pivotably attached to the first carriage such that rotation of the arm relative to first carriage causes a corresponding retainer to vertically raise, wherein the arm is connected to the second carriage via a connecting element and wherein the first and second carriages are moveable relative to each other within the linear guide such that movement of the first carriage towards the second carriage causes the rotation of the arm;

a pair of first linear drives each associated with one the motion devices for changing a longitudinal position of corresponding first and second carriages within a corresponding linear guide;

a pair of second linear drives each associated with one of the motion devices, each of the second linear drives being connected to corresponding first and second carriages for transferring motion from the first carriage to the second carriage and for changing the relative position between the first and second carriages to rotate a corresponding one of the arms, wherein the first linear drive forms a main drive that moves both carriages and the second linear drive relative to the frame; and a pair of a rotary drives each disposed on one of the arms for changing inclination of a respective retainer.

2. The apparatus as claimed in claim 1, wherein each of the second linear drives further comprises a force-transmitting element that couples the first and second carriages, and a distance between the first and second carriages is changeable by actuation of the force-transmitting element.

3. The apparatus as claimed in claim 1, wherein each of the second linear drives further comprises a rotary spindle that is rotatably secured at one end on the first carriage and at the other end on the second carriage.

4. The apparatus as claimed in claim 3, wherein a spindle drive of the rotary spindle is secured on one of the carriages.

5. The apparatus as claimed in claim 1, wherein each of the first linear drives further comprises a force-transmitting element that couples the first carriage to the frame.

6. The apparatus as claimed in claim 1, wherein each of the first linear drives further comprises a driven chain that is secured at one end on the first carriage and at the other end on the frame.

7. The apparatus as claimed in claim 1, wherein each of the rotary drives is arranged at a distance from the retainer and is coupled to the retainer by a force-transmitting means.

8. The apparatus as claimed in claim 1, wherein each of the rotary drives further comprises a belt arranged on a driving disk on the arm and on a driven disk on a retaining element.

9. The apparatus as claimed in claim 1, wherein each of the arms further includes a first end attached to a first carriage and a second end attached to the retainer.

10. The apparatus as claimed in claim 9, wherein the connecting element is connected to the arm between the first end and the second end.

11. The apparatus of claim 1 further comprising an adjustment device arranged above the retainers and is designed to support and adjust a location of a center of gravity of the person, wherein the adjustment device includes a strap connected to a vertical drive configured to adjust a vertical position of the person.

* * * * *